US009752534B2

(12) United States Patent
Arai et al.

(10) Patent No.: US 9,752,534 B2
(45) Date of Patent: Sep. 5, 2017

(54) FUEL SUPPLY APPARATUS FOR ENGINE

(71) Applicant: Honda Motor Co., Ltd., Tokyo (JP)

(72) Inventors: Tetsuya Arai, Wako (JP); Katsuki Honma, Wako (JP); Masaki Ando, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 33 days.

(21) Appl. No.: 14/755,290

(22) Filed: Jun. 30, 2015

(65) Prior Publication Data

US 2016/0017820 A1 Jan. 21, 2016

(30) Foreign Application Priority Data

Jul. 16, 2014 (JP) ..... 2014-145994

(51) Int. Cl.
*F02M 19/06* (2006.01)
*F02D 9/02* (2006.01)
(Continued)

(52) U.S. Cl.
CPC ..... *F02M 19/06* (2013.01); *F02D 2009/0201* (2013.01); *F02M 17/38* (2013.01); *F02M 37/0023* (2013.01)

(58) Field of Classification Search
CPC ..... F02M 19/06; F02M 1/043; F02M 7/24; F02M 1/02; F02M 13/08; F02D 41/1409; F02D 41/067; F02D 41/1477
See application file for complete search history.

(56) References Cited

U.S. PATENT DOCUMENTS 1,757,833 A * 5/1930 Haegler ..... F02M 1/043 261/121.3
3,738,334 A * 6/1973 Farr ..... F02M 31/18 123/557
(Continued)

FOREIGN PATENT DOCUMENTS

CN 101255828 A 9/2008
CN 102971514 A 3/2013
(Continued)

OTHER PUBLICATIONS

Office Action dated Jul. 25, 2017, issued in counterpart Japanese Application No. 2014-145994, with machine translation. (7 pages).
(Continued)

*Primary Examiner* — Stephen K Cronin
*Assistant Examiner* — Xiao Mo
(74) *Attorney, Agent, or Firm* — Westerman, Hattori, Daniels & Adrian, LLP

(57) ABSTRACT

An engine fuel supply apparatus includes: a fuel chamber provided in a carburetor; a first communication passage for opening the interior of the fuel chamber to the atmosphere; a second communication passage for communicating the interior of the fuel chamber with the interior of a Venturi section; and a passage switching section capable of switching between the first and second communication passages and mechanically connected to the main switch so that it can operate in response to the main switch shifting between an ignition position and a stop position. The passage switching section switches the second communication passage to the first communication passage in response to the main switch shifting from the stop position to the ignition position and switches the first communication passage to the second communication passage in response to the main switch shifting from the ignition position to the stop position.

3 Claims, 5 Drawing Sheets

(51) Int. Cl.
*F02M 37/00* (2006.01)
*F02M 17/38* (2006.01)

(56) References Cited

U.S. PATENT DOCUMENTS

| | | | | |
|---|---|---|---|---|
| 3,742,924 | A * | 7/1973 | Bachle | F02D 9/00 123/676 |
| 5,460,149 | A * | 10/1995 | Tofel | F02M 7/11 123/676 |
| 2008/0211116 | A1 | 9/2008 | Zbytowski | |
| 2012/0325180 | A1 | 12/2012 | Montgomery | |
| 2013/0133618 | A1 | 5/2013 | Larsson et al. | |

FOREIGN PATENT DOCUMENTS

| | | | |
|---|---|---|---|
| JP | 06-117329 | A | 4/1994 |
| JP | 11-137976 | A | 5/1999 |
| JP | 2005-133564 | A | 5/2006 |
| JP | 2007-278261 | A | 10/2007 |
| WO | 2012/177478 | A2 | 12/2012 |

OTHER PUBLICATIONS

Office Action dated May 2, 2017, issued in counterpart Chinese Application No. 201510183980.8, with English machine translation. (13 pages).

* cited by examiner

FUEL SUPPLY APPARATUS FOR ENGINE

FIELD OF THE INVENTION

The present invention relates a fuel supply apparatus for a general-purpose engine.

BACKGROUND OF THE INVENTION

In general, where an ordinary general-purpose engine is employed in a working machine or the like, the engine is deactivated or stopped by a human operator operating a main switch to a stop position to turn off an ignition device. Negative pressure in the interior of a Venturi section of a carburetor is canceled by the deactivation of the engine. As a consequence, fuel spray from a fuel chamber, provided in the carburetor, into the Venturi section is stopped.

However, due to inertia, the engine completely stops after having continued rotation for a certain time. Namely, some idling time is required before the engine completely stops. If an air-fuel mixture is supplied from the Venturi section of the carburetor to the engine during the idling, there can occur a so-called afterburn in which the air-fuel mixture remains unburned in the engine and muffler and temporarily ignites. A technique for preventing such an afterburn is known, for example, from Japanese Patent Application Laid-open Publication No. 2005-133564 (hereinafter "the relevant patent literature").

A fuel supply apparatus for an engine (engine fuel supply apparatus) disclosed in the relevant patent literature includes an electromagnetic valve (fuel shutoff valve) in a fuel supply line for supplying fuel from a fuel tank to a fuel chamber of a carburetor. A control section performs control for automatically closing the electromagnetic valve for a predetermined time after the engine is deactivated by an operation of a main switch. As a consequence, the fuel supply from the fuel tank to the fuel chamber is shut off until the engine is completely deactivated.

However, the fuel supply apparatus disclosed in the relevant patent literature employs a multiplicity of electric component parts, such as the electromagnetic valve, the control section for controlling the electromagnetic valve, and a power supply section for supplying electric power to the electromagnetic valve and the control section. As known, general-purpose engines are less costly than vehicle engines. Thus, employing the multiplicity of electric component parts in such an inexpensive general-purpose engine would lead a great ratio of the total cost of the electric component parts to the overall cost of the entire general-purpose engine. Because employing the multiplicity of electric component parts becomes a cause for a cost increase of the general-purpose engine, the fuel supply apparatus disclosed in the relevant patent literature is yet to be improved.

SUMMARY OF THE INVENTION

In view of the foregoing prior art problems, it is an object of the present invention to provide an improved technique capable of preventing occurrence of an afterburn by use of an inexpensive fuel supply apparatus.

In order to accomplish the above-mentioned object, the present invention provides an improved fuel supply apparatus for an engine (engine fuel supply apparatus) for spraying fuel, stored in a fuel chamber provided in a carburetor, to the interior of a Venturi section in a throttle body of the carburetor in accordance with negative pressure in the interior of the Venturi section, which comprises: a first communication passage for opening the interior of the fuel chamber to the atmosphere; a second communication passage for communicating the interior of the fuel chamber with the interior of the Venturi section; and a passage switching section configured to switch between the first communication passage and the second communication passage, the passage switching section being mechanically connected to the main switch so that the passage switching section can operate in response to a switching operation of the main switch between the ignition position and the stop position for igniting or deactivating an ignition device of the engine, the passage switching section being constructed to: switch the second communication passage to the first communication passage in response to the main switch shifting from the stop position to the ignition position; and switch the first communication passage to the second communication passage in response to the main switch shifting from the ignition position to the stop position.

The passage switching section, capable of switching between the first communication passage and the second communication passage, is mechanically connected to the main switch so that it can operate in response to (or in interlocked relation to) the switching operation of the main switch between the ignition position and the stop position.

Once the main switch is operated to shift to the ignition position, the ignition device is turned on. In response to the main switch shifting from the stop position to the ignition position like this, the passage switching section switches the second communication passage to the first communication passage. Therefore, the interior of the fuel chamber (float chamber) is opened to the atmosphere and thus assumes the atmospheric pressure level. Then, the engine is rotated, so that negative pressure is produced in the interior of the Venturi section. The fuel Fu stored in the fuel chamber is sprayed into (i.e., to the interior of) the Venturi section in accordance with the negative pressure. The engine outputs power in accordance with a supplied amount of the air-fuel mixture.

Once the main switch is operated to shift to the stop position, on the other hand, the ignition device is turned off, so that the engine starts idling. In response to the main switch shifting from the ignition position to the stop position like this, the passage switching section switches the first communication passage to the second communication passage. Therefore, the interior of the fuel chamber is placed in communication with the interior of the Venturi section. As a consequence, inner pressure of the Venturi section assumes the same level as inner pressure of the fuel chamber, so that the fuel stored in the fuel chamber is not sprayed into the Venturi section. Thus, after the main switch has been operated to shift to the stop position, no air-fuel mixture is supplied from the Venturi section to the engine during idling of the engine, so that it is possible to prevent occurrence of the so-called afterburn where the air-fuel mixture remains unburned in the engine and muffler and temporarily ignites. Finally, the engine stops completely.

Besides, the fuel supply apparatus of the present invention is simple in construction with merely the passage switching section, capable of switching between the first communication passage and the second communication passage, mechanically connected to the main switch, requiring no electrical component. Thus, occurrence of the afterburn can be prevented by the fuel supply apparatus comprising only simple and less costly mechanical components. Therefore, overall cost of the general-purpose engine can be minimized.

Further, while the main switch is at the stop position OFF, the first communication passage is shut off from the outside.

Thus, during stoppage of the general-purpose engine, the interior of the fuel chamber is shut off from the atmosphere, so that a fuel evaporative emission can be prevented from dissipating from the fuel chamber to the atmosphere and thus it is possible to minimize the dissipation of the fuel evaporative emission from the general-purpose engine to the atmosphere. Besides, even where a catalyst layer is added to a breather or vent in the first communication passage, the fuel evaporative emission can be prevented from flowing from the fuel chamber to the catalyst layer during stoppage of the general-purpose engine. Still further, even when the general-purpose engine is put down sideways, there is no possibility of the fuel stored in the fuel chamber flowing to the outside through the first communication passage.

Preferably, in the fuel supply apparatus of the present invention, the passage switching section capable of switching between the first and second communication passages comprises a three-way valve. Use of the three-way valve can simplify the construction of the passage switching section.

Further, preferably, in the fuel supply apparatus of the present invention, the three-way valve is disposed coaxially with the main switch and connected via a shaft to the main switch so that the three-way valve can operate in interlocked relation to the main switch. This arrangement can simplify the construction that mechanically connects the passage switching section to the main switch.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

Now, an embodiment of a fuel supply apparatus for an engine (engine fuel supply apparatus) according to the present invention will be described with reference to the accompanying drawings.

Figure 1:
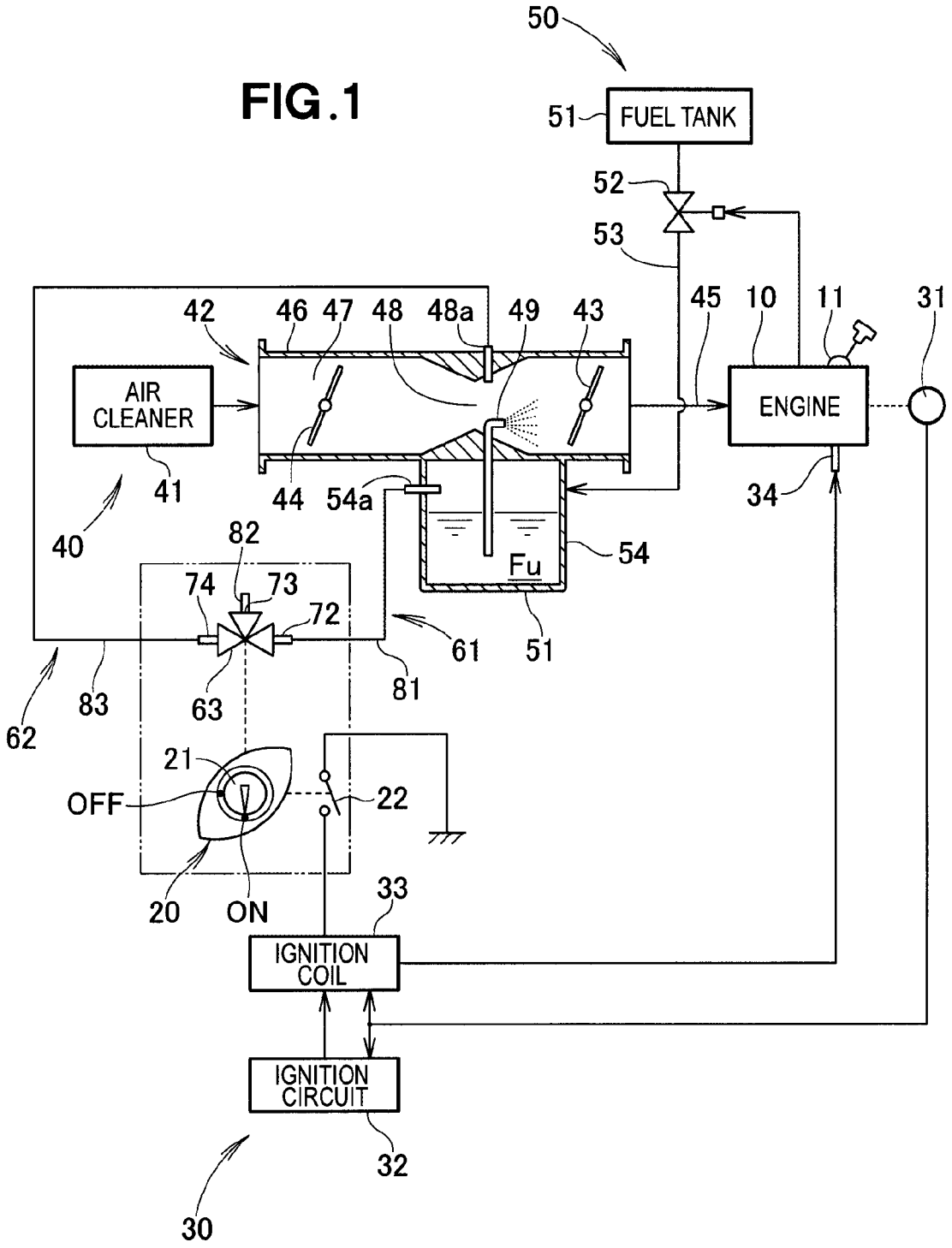
FIG. 1 is a schematic view illustrating a general-purpose engine, a main switch, an engine ignition device, an engine air intake device and an engine fuel supply apparatus according to an embodiment of the present invention.

As shown in FIG. 1, the engine 10 is, for example, a transversely-oriented, single-cylinder, two-cycle general-purpose engine. The "general-purpose engine" is a generic term for internal combustion engines provided on various working machines, such as electric power generators, pumps, outboard engines, agricultural working machines, civil engineering machines and transport vehicles. The engine 10 includes a recoil starter 11, a main switch 20, an engine ignition device 30, an engine air intake device 40, and the engine fuel supply apparatus 50.

The recoil starter 11 is an activation device operable by a human operator to manually activate the engine 10, and the recoil starter 11 is provided on a crankshaft of the engine 10 or on a flywheel connected directly to the crankshaft.

The main switch 20 is a manual main power switch for activating and deactivating the engine 10. Namely, the main switch 20 is operable to ignite and stop the engine ignition device 30. More specifically, the main switch 20 is a rotary switch having an operating knob 21 rotatable to actuate a switch contact 22.

The engine ignition device 30 includes an electric power generator 31, an ignition circuit 32, an ignition coil 33, and an ignition plug 34. For example, an ordinary magnetic-power-generating ignition device (flywheel magneto ignition device) is employed as the engine ignition device 30. The magnetic-power-generating ignition device 30 includes the power generator 31 connected directly to the crankshaft of the engine 10, and it directly uses, as primary power, electric power generated by the generator 31 without storing the generated electric power in a battery.

A high-voltage intermittent current generated in a secondary coil of the ignition coil 33 is supplied to the ignition plug 34. Ignition timing (ignition time) of the ignition plug 34 varies depending on the number of rotations of the crankshaft. Namely, the electric power generated by the generator 31 is supplied to the ignition circuit 32 and the ignition coil 33. The ignition coil 33 is controlled by the ignition circuit 32 to apply high-voltage electric power to the ignition plug 34.

While the operating knob 21 of the main switch 20 is at an ignition position ON, the switch contact 22 is kept in an opened state. The crankshaft of the engine 10 rotates in response to the human operator operating the operating knob 21 to shift to the ignition position ON and then activating the recoil starter 11. As a consequence, the power generator 31 is driven by the crankshaft of the engine 10 to start generating electric power, and the ignition circuit 32 is automatically activated by the electric power supplied from the electric power generator. Thus, high-voltage electric power is applied from the ignition coil 33 to the ignition plug 34.

Once the human operator operates the operating knob 21 of the main switch 20 to shift to a stop position OFF, the switch contact 22 is placed in a closed state. A power line for supplying electric power from the power generator 31 to the ignition circuit 32 and the ignition coil 33 is connected to the earth via the switch contact 22. Thus, in response to the switch contact 22 being placed in the closed state, the application of the high-voltage electric power from the ignition coil 33 to the ignition plug 34 is terminated.

Further, the engine intake device 40 includes an air cleaner 41, a carburetor 42, a throttle valve 43, and a choke valve 44. External air introduced via the air cleaner 41 is delivered to an air intake port of the engine 10 by way of the carburetor 42 and an air intake pipe 45.

Further, the carburetor 42 includes an air intake passage 47 within a throttle body 46 (carburetor body 46), and a diameter-reduced Venturi section 48 in a middle interior portion of the air intake passage 47. The throttle valve 43 is disposed in the air intake passage 47 downstream of the Venturi section 48, and the choke valve 44 is disposed in the air intake passage 47 upstream of the Venturi section 48. Further, a spray nozzle 49 for spraying fuel is provided in the Venturi section 48.

Further, the fuel supply apparatus 50 includes a fuel tank 51, an auto fuel cock 52, a fuel supply passage 53, and a fuel chamber 54. The fuel tank 51 is disposed above the carburetor 42. The auto fuel cock 52 is a valve that automatically opens by negative pressure within a crankcase of the engine 10. The fuel supply passage 53 connects a lower-end exit of the auto fuel cock 52 to the fuel chamber 54. The fuel chamber 54 (float chamber 54) is provided in the carburetor 42 for temporarily storing fuel Fu. The spray nozzle 49 is connected to the fuel chamber 54.

Fuel stored in the fuel tank 51 is supplied to the fuel chamber 54 via the auto fuel cock 52 and the fuel supply passage 53. Namely, the fuel is supplied from the fuel tank 51 to the fuel chamber 54 by the gravitational force, although the fuel supply from the fuel tank 51 to the fuel chamber 54 may be effected by a pump rather than by the gravitational force.

With the fuel supply apparatus 50, the fuel Fu stored in the fuel chamber 54 can be sprayed via the spray nozzle 49 to the interior of the Venturi section 48 in accordance with negative pressure within the Venturi section 48. The thus-sprayed fuel is mixed with air, so that the air-fuel mixture is supplied from the Venturi section 48 to the engine 10.

Figure 2:
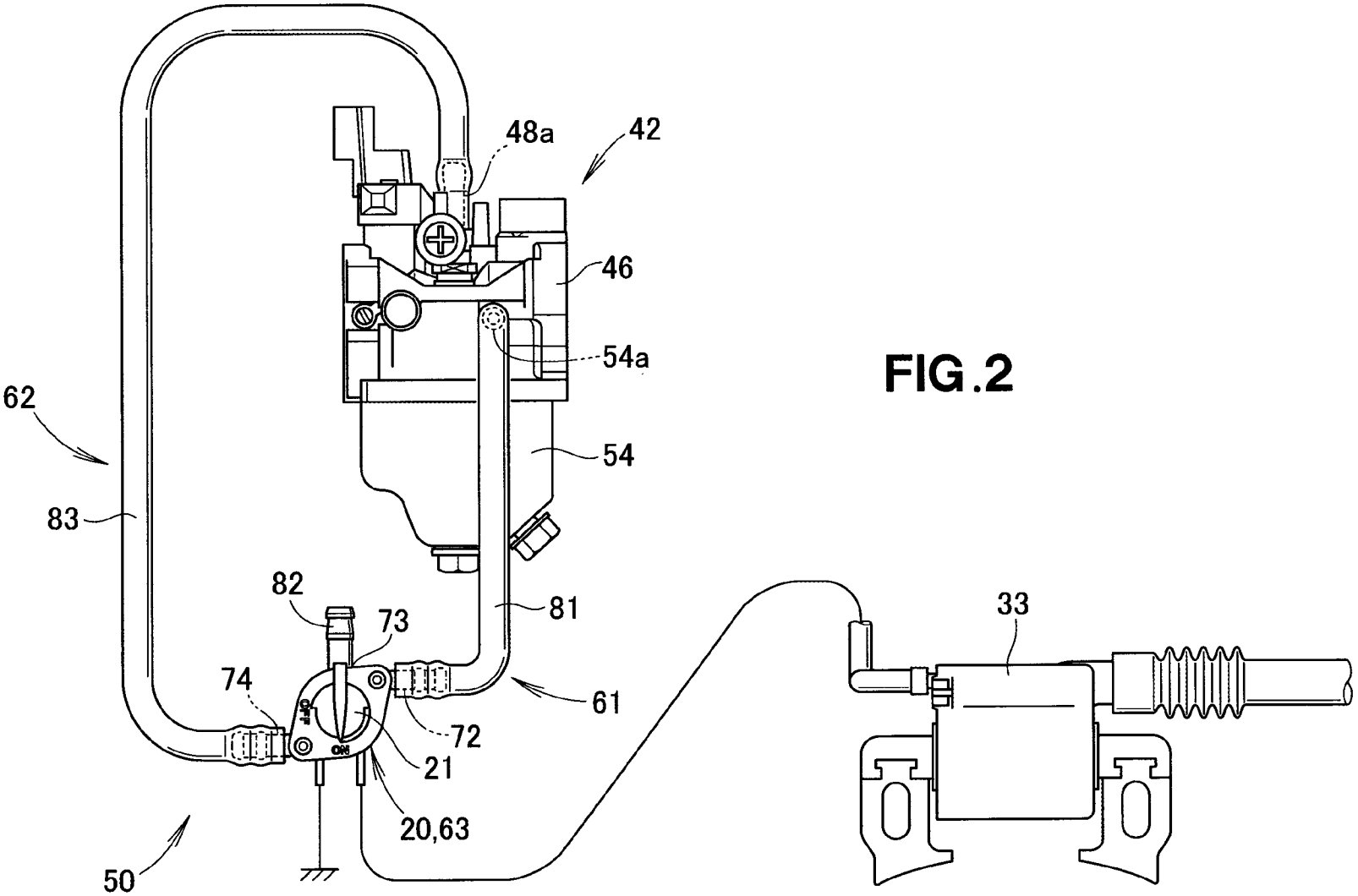
FIG. 2 is a view showing outer appearances of the main switch, an ignition coil, the engine air intake device and the engine fuel supply apparatus shown in FIG. 1.

Further, as shown in FIGS. 1 and 2, the engine fuel supply apparatus 50 includes: a first communication passage 61 that communicates the interior of the fuel chamber 54 with the atmosphere; a second communication passage 62 that communicates the interior of the fuel chamber 54 with the interior of the Venturi section 48; and a passage switching section 63 capable of switching between the first communication passage 61 and the second communication passage 62.

Figure 3:
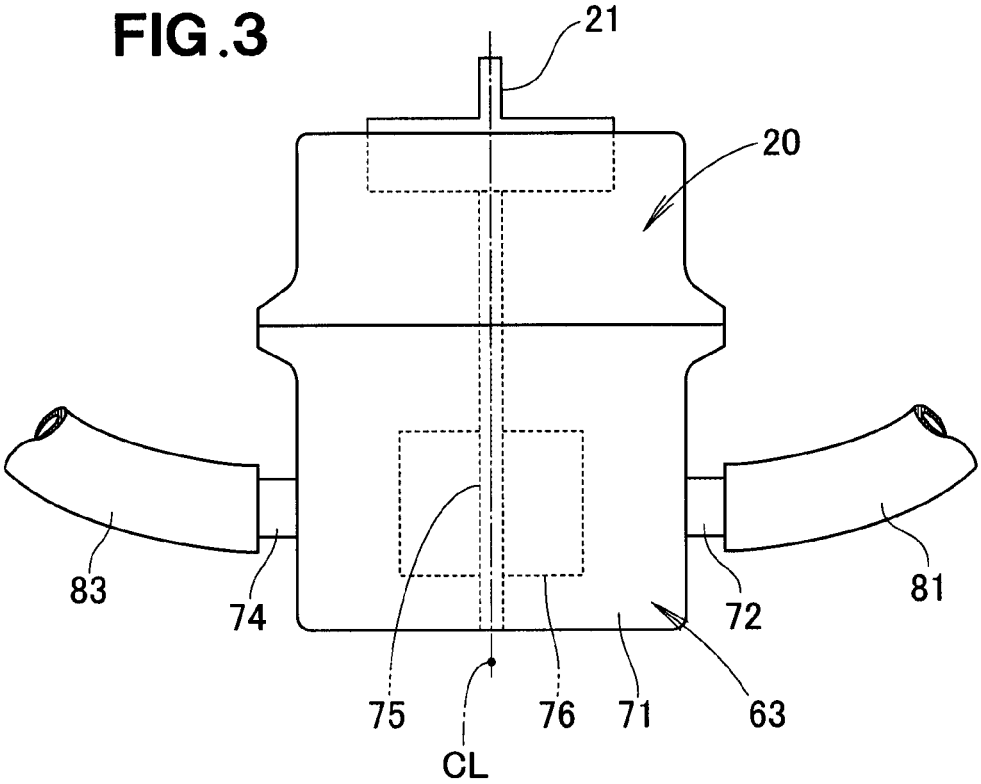
FIG. 3 is a view showing outer appearances of the main switch and a three-way valve shown in FIG. 2.
Figure 4:
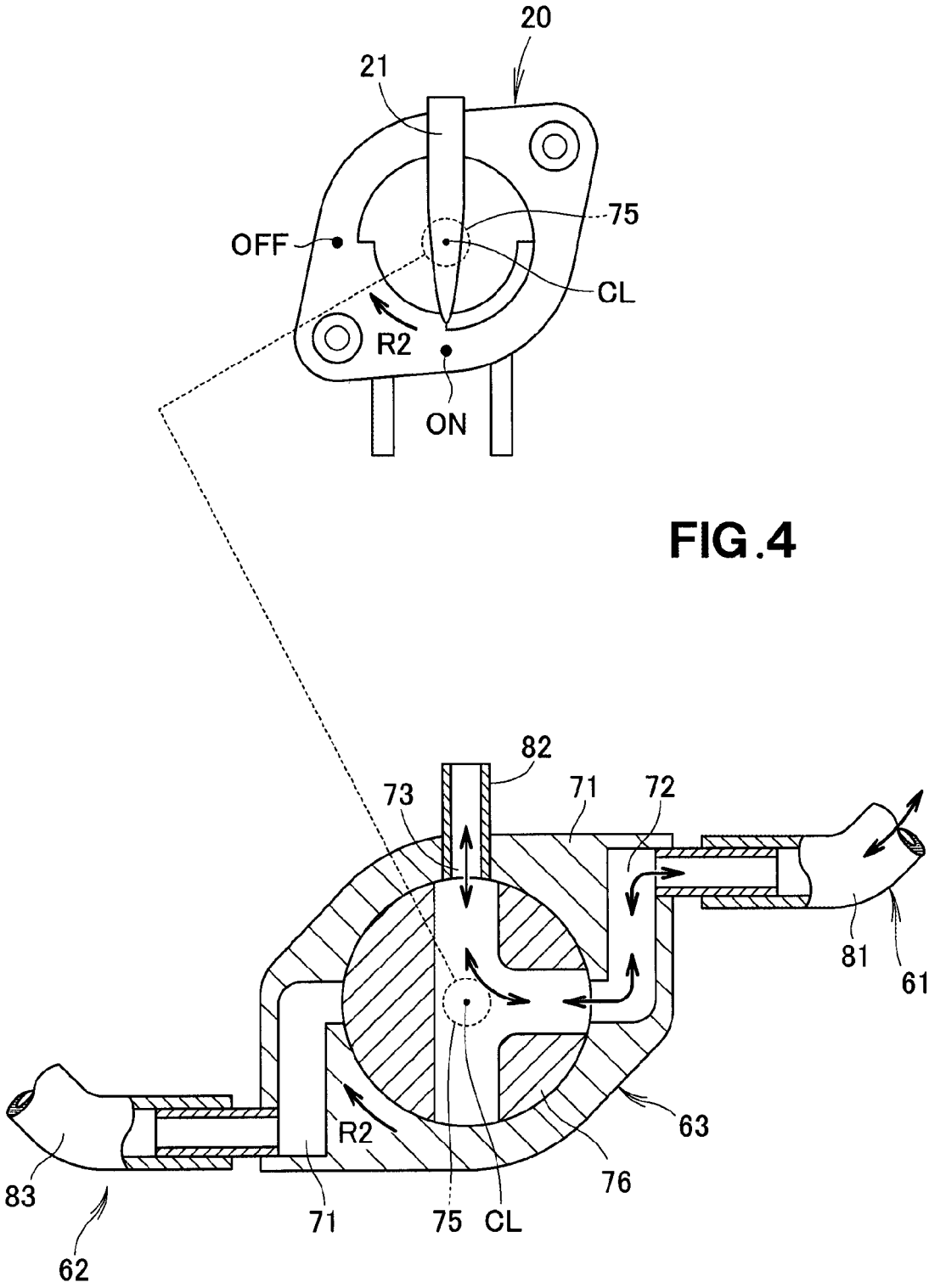
FIG. 4 is a sectional view of the three-way valve when the main switch shown in FIG. 3 is at an ignition position.

More specifically, the passage switching section 63 comprises a three-way valve as shown in FIGS. 3 and 4; hereinafter, the passage switching section 63 will be referred to also as "three-way valve 63" as appropriate. The three-way valve 63 is constructed to change communicating states of three ports 72, 73 and 74, formed in a valve box 71, by means of a valve body 76 provided on a valve rod 75. Namely, the passage switching section 63 comprises the three-way valve 63 that is of a small size and simple construction. Thus, it is possible to simplify the construction of the fuel supply apparatus 50 including the first communication passage 61 and the second communication passage 62.

Further, as shown in FIGS. 1 and 4, the first port 72 is connected via a first communication pipe 81 to a breather (vent hole) 54*a* provided in an upper portion of the fuel chamber 54. A vent 82 is connected to the second port 73. The vent 82 is a pipe capable of communicating with the atmosphere. The third port 74 is connected via a second communication pipe 83 to a breather 48*a* communicating with the interior of the Venturi section 48. The first communication pipe 81 and the second communication pipe 83 are each in the form of a hose.

A combination of the first communication pipe 81 and the vent 82 constitutes the first communication passage 61, and a combination of the first and second communication pipes 81 and 83 constitutes the second communication passage 62.

The three-way valve 63 (i.e., passage switching section 63) is mechanically connected to the main switch 20 in such a manner that it can operate in response to (in interlocked relation to) the switching operation of the main switch 20 between the ignition position ON and the stop position OFF. The three-way valve 63 is constructed to switch from the second communication pipe 62 to the first communication passage 61 in response to the main switch 20 switching from the stop position OFF to the ignition position ON and switch from the first communication pipe 61 to the second communication passage 62 in response to the main switch 62 switching from the ignition position ON to the stop position OFF.

Further, as shown in FIGS. 3 and 4, the main switch 20 and the three-way valve 63 are disposed coaxially with each other. The three-way valve 63 is connected to the main switch 20 via the shaft 75 (i.e., valve rod 75) in such a manner that it can operate in interlocked relation to the main switch 20. Thus, it is possible to simplify a construction that mechanically connects the three-way valve 63 (passage switching section 63) to the main switch 20.

For example, the valve rod 75 functions also as a rotation shaft of the main switch 20 (rotary switch). The operating knob 21 is mounted on one end portion of the valve rod 75. Thus, the main switch 20 and the three-way valve 63 are located on the centerline CL of the valve rod 75.

Figure 5:
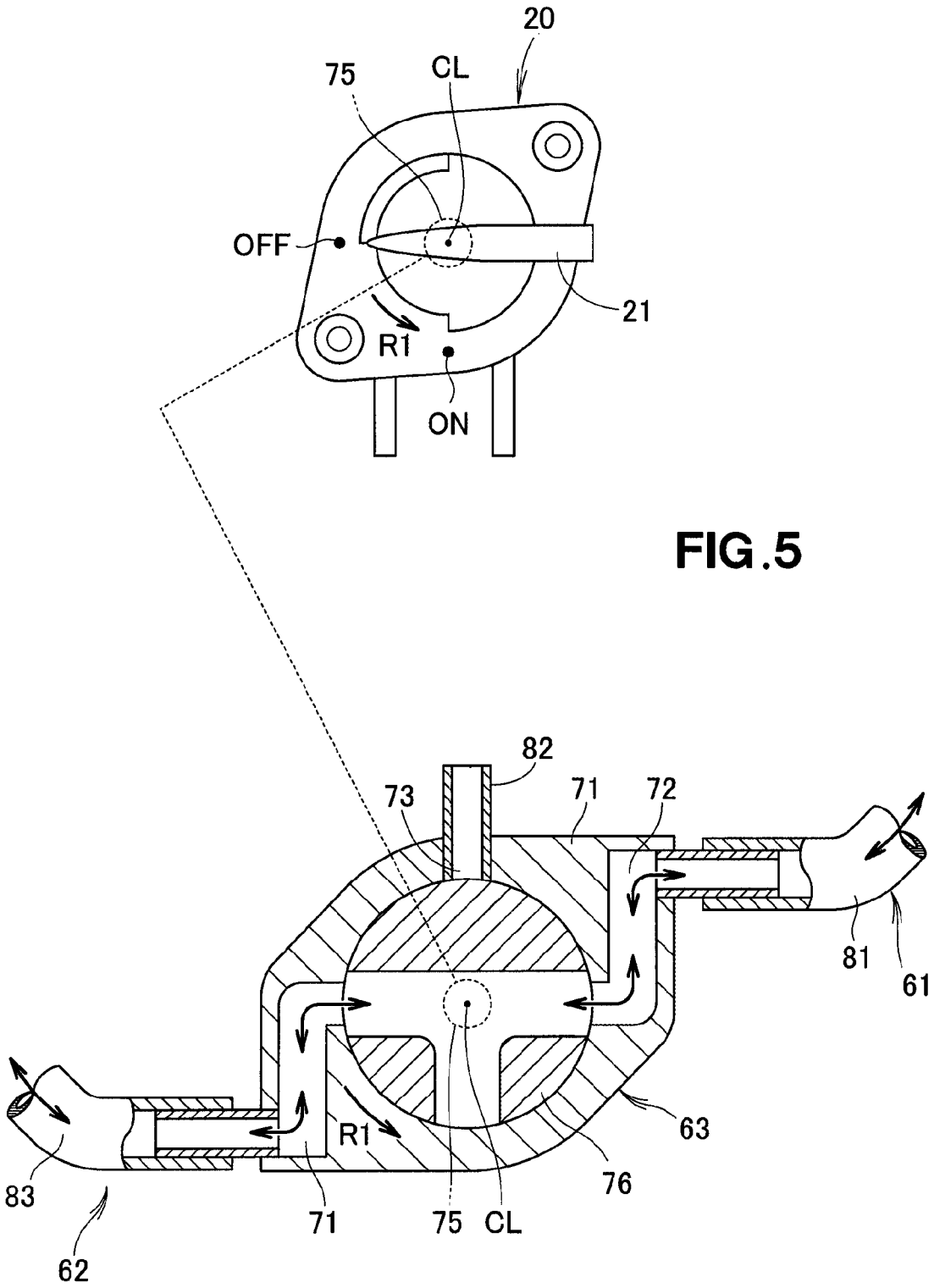
FIG. 5 is a sectional view of the three-way valve when the main switch of FIG. 3 is at a stop position.

The foregoing description may be summarized as follows. Once the main switch 20 is operated to shift to the ignition position ON as shown in FIG. 1, the ignition device 30 is turned on, so that high-voltage electric power is applied from the ignition coil 33 to the ignition plug 34. Namely, as the operating knob 21 shown in FIG. 5 is turned in a counterclockwise direction (indicated by arrow R1), the shaft 75 rotates in the same direction, so that the main switch 20 shifts from the stop position OFF to the ignition position ON. At the same time, the valve body 76 of the three-way valve 63 rotates in the counterclockwise direction to thereby communicate between the first port 72 and the second port 73, so that the first communication pipe 81 communicates with the external air via the vent 82.

Namely, in response to the main switch 20 shifting from the stop position OFF to the ignition position ON as shown in FIG. 1, the three-way valve 63 switches the second communication passage 62 to the first communication passage 61. Therefore, the interior of the Venturi section 48 is opened to the atmosphere and thus assumes the atmospheric pressure level. Then, as the engine 10 is rotated, negative pressure is produced in the interior of the Venturi section 48, so that the fuel Fu stored in the fuel chamber 54 is sprayed into the Venturi section 48 in accordance with the negative pressure. Thus, the engine 10 outputs power in accordance with a supply amount of the air-fuel mixture.

Once the main switch 20 is operated to shift to the stop position OFF, on the other hand, the ignition device 30 is turned off, so that the high-voltage electric power is no longer applied from the ignition coil 33 to the ignition plug 34. As a consequence, the engine 10 starts idling. Namely, as the operating knob 21 shown in FIG. 4 is turned in a clockwise direction (indicated by arrow R2), the shaft 75 turns in the same direction, so that the main switch 20 shifts from the ignition position ON to the stop position OFF. At the same time, the valve body 76 of the three-way valve 63 rotates in the clockwise direction to thereby communicate between the first port 72 and the third port 74, so that the first communication pipe 81 and the second communication pipe 83 communicate with each other.

Namely, the three-way valve 63 switches the first communication passage 81 to the second communication passage 62 in response to the main switch 20 shifting from the ignition position ON to the stop position OFF. Thus, as shown in FIG. 1, the interior of the fuel chamber 54 is brought into communication with the interior of the Venturi section 48. As a consequence, inner pressure of the Venturi section 48 assumes the same level as inner pressure of the fuel chamber 54, and the fuel stored in the fuel chamber 54 is not sprayed into the Venturi section 48. Thus, after the main switch 20 has been operated to the stop position OFF, no air-fuel mixture is supplied from the Venturi section 48 to the engine 10 during idling of the engine 10, so that it is possible to prevent occurrence of the so-called afterburn where the air-fuel mixture remains unburned in the engine and muffler and temporarily ignites. Finally, the engine 10 stops completely.

Besides, the fuel supply apparatus 50 of the present invention is simple in construction with merely the passage switching section 63, capable of switching between the first communication passage 61 and the second communication passage 62, mechanically connected to the main switch 20, requiring no electrical component. Thus, occurrence of the afterburn can be prevented by the fuel supply apparatus 50 comprising only simple and inexpensive mechanical components. Therefore, overall cost of the entire general-purpose engine 10 can be reduced.

Further, while the main switch 20 is at the stop position OFF, the first communication passage 61 is shut off from the outside. Thus, during stoppage of the general-purpose engine 10, the interior of the fuel chamber 54 is shut off from the atmosphere, so that a fuel evaporative emission can be prevented from dissipating from the fuel chamber to the atmosphere and thus it is possible to minimize the dissipation of the fuel evaporative emission from the general-purpose engine 10 to the atmosphere. Besides, even where a catalyst layer is added to the breather or vent 82 in the first communication passage 61, the fuel evaporative emission can be prevented from flowing from the fuel chamber 54 to the catalyst layer during stoppage of the general-purpose engine 10. Still further, even when the general-purpose engine 10 is put down sideways, there is no possibility of the fuel FU stored in the fuel chamber 54 flowing to the outside through the first communication passage 61.

The fuel supply apparatus of the present invention is well suited for application to general-purpose engines mounted on various working machines.

What is claimed is:

1. A fuel supply apparatus for an engine for spraying fuel, stored in a fuel chamber provided in a carburetor, to an interior of a Venturi section in a throttle body of the carburetor in accordance with negative pressure in the interior of the Venturi section, the engine fuel supply apparatus comprising:

a first communication passage for opening an interior of the fuel chamber to an atmosphere;

a second communication passage for communicating the interior of the fuel chamber with the interior of the Venturi section; and a passage switching section configured to switch between the first communication passage and the second communication passage, the passage switching section being mechanically connected to a main switch so that the passage switching section can operate in response to an switching operation of the main switch between the ignition position and the stop position for igniting or deactivating an ignition device of the engine, the passage switching section being constructed to: switch the second communication passage to the first communication passage in response to the main switch shifting from the stop position to the ignition position; and switch the first communication passage to the second communication passage in response to the main switch shifting from the ignition position to the stop position, wherein the passage switching section includes a valve rod connected to the main switch and a valve body connected to the valve rod, the passage switching section switching between the ignition position and the stop position by rotating the main switch and thereby rotating the valve rod and the valve body between the ignition position and the stop position.

2. The fuel supply apparatus according to claim 1, wherein the passage switching section comprises a three-way valve.

3. The fuel supply apparatus according to claim 2, wherein the valve body is disposed coaxially with the main switch.

* * * * *